US010781567B2

(12) United States Patent
Li et al.

(10) Patent No.: US 10,781,567 B2
(45) Date of Patent: Sep. 22, 2020

(54) FOUNDATION TREATMENT METHOD FOR PILING FOUNDATION STRUCTURE BY PENETRATING HARDPAN LAYER

(71) Applicant: CCCC FIRST HARBOR ENGINEERING CO., LTD., Tianjin (CN)

(72) Inventors: Yiyong Li, Tianjin (CN); Naishou Zhang, Tianjin (CN); Chao Gao, Tianjin (CN); Zengjun Li, Tianjin (CN); Bingchuan Guo, Tianjin (CN)

(73) Assignee: CCCC FIRST HARBOR ENGINEERING CO., LTD., Tianjin (CN)

( * ) Notice: Subject to any disclaimer, the term of this patent is extended or adjusted under 35 U.S.C. 154(b) by 0 days.

(21) Appl. No.: 16/597,772

(22) Filed: Oct. 9, 2019

(65) Prior Publication Data

US 2020/0040542 A1 Feb. 6, 2020

Related U.S. Application Data

(63) Continuation-in-part of application No. PCT/CN2017/114771, filed on Dec. 6, 2017.

(30) Foreign Application Priority Data

Apr. 17, 2017 (CN) ..... 2017 1 0248966

(51) Int. Cl.
*E02D 27/52* (2006.01)
*E02D 3/12* (2006.01)
(Continued)

(52) U.S. Cl.
CPC ..... *E02D 3/12* (2013.01); *E02B 17/0008* (2013.01); *E02D 5/46* (2013.01); *E02D 23/16* (2013.01); *E02D 3/08* (2013.01); *E02D 27/525* (2013.01)

(58) Field of Classification Search
CPC ..... E02D 27/52; E02D 27/525; E02D 23/02; E02D 23/08; E02D 23/16; E02B 17/02;
(Continued)

(56) References Cited

U.S. PATENT DOCUMENTS 3,436,921 A * 4/1969 Isaacs ..... E02D 7/22 405/249
3,638,433 A * 2/1972 Sherard ..... E02D 1/04 405/50

(Continued)

FOREIGN PATENT DOCUMENTS

CN 1536173 A 10/2004
CN 106088120 A 11/2016

(Continued)

OTHER PUBLICATIONS

The International Search Report of corresponding International application No. PCT/CN2017/114771, dated Mar. 6, 2018.

(Continued)

*Primary Examiner* — Frederick L Lagman
(74) *Attorney, Agent, or Firm* — J.C. Patents

(57) ABSTRACT

A foundation treatment method for piling a foundation structure by penetrating a hardpan layer, i.e., a Deep Slurry Mixing method, comprising following steps: disturbing, by a mechanical device, a location where the foundation structure is to be piled, so that the mechanical device penetrates the hardpan layer of a natural foundation; then injecting clay slurry into the hardpan layer of the natural foundation by a pumping device, an improved foundation is formed after mixing; and piling the foundation structure. The method can change soil property of the original natural foundation, break the hardpan layer, reduce piling resistance of the steel plate cylinder or similar foundation structure, reduce uneven force during the piling process and improve driveability.

18 Claims, 1 Drawing Sheet

(51) Int. Cl.

| | |
|---|---|
| ***E02B 17/00*** | (2006.01) |
| ***E02D 23/16*** | (2006.01) |
| ***E02D 5/46*** | (2006.01) |
| *E02D 3/08* | (2006.01) |

(58) Field of Classification Search
CPC ..... E02B 17/0008; E02B 2017/0039; E02B 2017/0043
USPC ..... 405/249
See application file for complete search history.

(56) References Cited

U.S. PATENT DOCUMENTS

| | | | | | |
|---|---|---|---|---|---|
| 3,992,890 | A * | 11/1976 | Pryke | E02D 5/226 | 405/232 |
| 4,707,956 | A * | 11/1987 | Sato | E02D 5/38 | 52/167.4 |
| 4,815,894 | A * | 3/1989 | Copson | B09B 1/002 | 376/272 |
| 5,378,085 | A * | 1/1995 | Kono | E02D 3/126 | 405/233 |
| 6,672,805 | B1 * | 1/2004 | White | E02D 7/18 | 173/42 |
| 7,104,732 | B2 * | 9/2006 | Mignacca | E02D 5/385 | 405/235 |
| 7,390,144 | B2 * | 6/2008 | Fedrick | E02D 5/32 | 405/233 |
| 2005/0281625 | A1 * | 12/2005 | Mignacca | E02D 5/385 | 405/255 |
| 2010/0232887 | A1 * | 9/2010 | Parsons | E02D 5/385 | 405/237 |
| 2012/0076591 | A1 * | 3/2012 | Peters | E02D 7/16 | 405/228 |
| 2015/0071711 | A1 * | 3/2015 | Wong | E02B 17/00 | 405/226 |
| 2016/0376762 | A1 * | 12/2016 | Wong | E02B 17/0008 | 405/210 |
| 2018/0340312 | A1 * | 11/2018 | Zhou | E02D 27/425 | |

FOREIGN PATENT DOCUMENTS

| | | | | |
|---|---|---|---|---|
| CN | 106337430 | A | 1/2017 | |
| CN | 106381870 | A | 2/2017 | |
| JP | S4948213 | B1 | 12/1974 | |
| JP | H07-247543 | A | 9/1995 | |
| JP | H07269260 | A | 10/1995 | |
| JP | 2014-129675 | A | 7/2014 | |
| JP | 2017-002464 | A | 1/2017 | |
| WO | WO-2011059145 | A1 * | 5/2011 | E02D 27/14 |
| WO | 2015068879 | A1 | 5/2015 | |

OTHER PUBLICATIONS

The Chinese Examination Report of corresponding Chinese application No. 201710248966.0, dated Feb. 22, 2019.

* cited by examiner

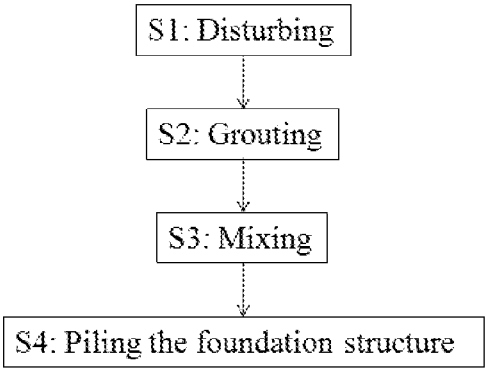
S1: Disturbing
S2: Grouting
S3: Mixing
S4: Piling the foundation structure

FOUNDATION TREATMENT METHOD FOR PILING FOUNDATION STRUCTURE BY PENETRATING HARDPAN LAYER

CROSS-REFERENCE TO RELATED APPLICATIONS

The present application is a continuation-in-part application of International Application No. PCT/CN2017/114771 filed on Dec. 6, 2017 which claims priority to Chinese Patent Application No. 201710248966.0 filed on Apr. 17, 2017. The disclosures of the aforementioned applications are hereby incorporated by reference in their entireties.

TECHNICAL FIELD

The present application relates to the technical field of foundation treatment engineering construction methods, and in particular to a foundation treatment method for piling a foundation structure by penetrating a hardpan layer, i.e., a Deep Slurry Mixing method.

BACKGROUND OF THE PRESENT INVENTION

Large-diameter steel plate cylinders are important cofferdam structures for construction of artificial islands at sea. During the construction, the steel plate cylinders need to be inserted to tens of meters below seabed foundation. When soil texture of the foundation in the construction sea area is uneven and there is a hardpan layer with sand, it is likely to cause uneven force, stress concentration, structural deformation and other phenomena during piling and sinking processes of the steel plate cylinder. As a result, the progress of piling the steel plate cylinder is slow, positioning is inaccurate and operation efficiency is low, so that a construction schedule is influenced. For a particular foundation where there is a thick sand layer, the construction may be stopped due to insufficient piling strike force. Therefore, it is necessary to develop a foundation treatment method for piling a foundation structure which can penetrate a hardpan layer without limitations from geological conditions, improve operation capability.

SUMMARY OF THE PRESENT INVENTION

In view of the above problems in the current piling processes of large-diameter steel plate cylinders or similar structures, the present application provides a foundation treatment method for piling a foundation structure by penetrating a hardpan layer, i.e., a Deep Slurry Mixing (DSM) method.

To achieve the above object, the present application employs the following technical solutions.

A foundation treatment method for piling a foundation structure by penetrating a hardpan layer (i.e., a DSM method) is provided, comprising the following operating steps:

(1) disturbing: disturbing, by a mechanical device, a location where the foundation structure is to be piled, so that the mechanical device penetrates the hardpan layer of a natural foundation;

(2) grouting: injecting clay slurry into the location disturbed in the step (1) by a pumping device;

(3) mixing: mixing the clay slurry in the step (2) with the hardpan layer of the natural foundation by a stirring device to form an improved foundation; and (4) piling the foundation structure: embedding the foundation structure into the improved foundation in the step (3) by a vibration equipment.

Preferably, the mechanical device in the step (1) is one of a Cement Deep Mixing ship processor, a land drilling device and an excavating device.

Preferably, the disturbing in the step (1) is one of drilling, excavating and chiseling.

Preferably, the clay slurry in the step (2) is prepared from bentonite.

Preferably, the clay slurry is prepared by mixing water and the bentonite, a mass ratio of water to the bentonite is equal to or greater than 0.7, and a specific gravity of the clay slurry is equal to or greater than 1.3.

Preferably, the clay slurry is prepared by mixing water and the bentonite at a mass ratio of 1.15 and the specific gravity of the clay slurry is 1.48.

Preferably, a flow rate of the grouting in the step (2) is 250-450 L/min.

Preferably, the stirring device in the step (3) is a stirring wing at a lower end of the mechanical device in the step (1).

Preferably, the foundation structure in the step (4) is one of a large-diameter steel plate cylinder, a steel plate cylinder, a combined steel plate cylinder and an arc structure of the large-diameter steel plate cylinder, the steel plate cylinder or the combined steel plate cylinder.

Preferably, the specific operating steps of the steps (1), (2) and (3) comprises:

① selecting a construction ship, and mounting the mechanical device;

② determining a location where the hardpan layer is to be penetrated according to a designed piling location of the foundation structure, positioning the ship by a positioning apparatus, and arranging the mechanical device in place;

③ checking operating state of a generator, ensuring that a water source of a water tank is sufficient, a fully-automated device works normally and a slurry pump is activated, determining a verticality of the mechanical device, checking instruments to ensure good operating state, and preparing for disturbance;

④ activating the generator, the fully-automated device runs normally, the mechanical device sinks rotationally and a cone tip at a lower end of the mechanical device enters water; controlling a sinking speed of the mechanical device to be 1.0 to 2.0 m/min until the cone tip reaches seabed;

⑤ the mechanical device continuously sinks rotationally, and controlling the sinking speed of the mechanical device to be 0.5 to 1.0 m/min during the cone tip descending from the seabed to a treatment top surface;

⑥ the mechanical device continuously sinks rotationally, controlling the sinking speed of the mechanical device to be 0.3 to 1.0 m/min during the cone tip descending from the treatment top surface to a treatment bottom surface; injecting the clay slurry through a slip pipe at a flow rate of 250-450 L/min, and rotating a stirring wing at the lower end of the mechanical device while sinking to mix soil body;

⑦ the mechanical device stops sinking after the cone tip reaches the treatment bottom surface, the stirring wing at the lower end of the mechanical device continuously rotates to mix the soil body for 3 to 5 min so as to fully mix natural soil with the clay slurry;

⑧ activating a reverse switch, reversely rotating and lifting the stirring wing at the lower end of the mechanical device, and lifting the cone tip to the treatment top surface, and controlling a lifting speed to be 0.3 to 1.0 m/min;

⑨ repeating the steps ⑥ to ⑧ for 3 to 5 times to ensure that the clay slurry is fully mixed with the natural soil, so as to form the improved foundation; and ⑩ lifting the stirring wing at the lower end of the mechanical device from the treatment top surface to sea surface, controlling the lifting speed to be 0.3 to 1.0 m/min, and moving the mechanical device to a next location where the hardpan layer is to be penetrated.

The present application has the following beneficial effects.

1. After being treated by the DSM method, the original hardpan layer is softened or weakened by injecting the clay slurry into the hardpan layer. Before the large-diameter steel plate cylinder or other structure is piled, the treated soil layer will not be obviously solidified or hardened, a pore ratio of the soil is larger, pore water pressure is increased, the occlusion between soil particles is reduced and a frictional resistance between the foundation structure and the soil is decreased. Therefore, the penetration resistance to the large-diameter steel plate cylinder or other structure can be effectively reduced, the uneven force during the piling process can be decreased, and the driveability can be improved.

2. By the method of the present application, a complicated foundation can be treated without limitations from the geological conditions, and the range of applications of steel plate cylinders or similar foundation structures can be expanded.

3. The present application employs a method of injecting clay slurry, which is wide in material source, low in cost and good in economic efficiency.

BRIEF DESCRIPTION OF DRAWINGS

FIG. 1 is a flowchart of a foundation treatment method for piling a foundation structure by penetrating a hardpan layer according to an embodiment of the present invention.

DETAILED DESCRIPTION OF THE PRESENT INVENTION

The present application will be described below in detail by exemplary embodiments. It should be understood that the method steps mentioned in the present application do not exclude other method steps before and after the combination of steps, or other method steps can be inserted before the steps explicitly mentioned.

In an embodiment of the present application, a foundation treatment method for piling a foundation structure by penetrating a hardpan layer (i.e., a DSM method) is provided, comprising the following operating steps:

(1) disturbing: disturbing, by a mechanical device, a location where the foundation structure is to be piled, so that the mechanical device penetrates the hardpan layer of a natural foundation;

(2) grouting: injecting clay slurry into the location disturbed in the step (1) by a pumping device;

(3) mixing: mixing the clay slurry in the step (2) with the hardpan layer of the natural foundation by a stirring device to form an improved foundation; and (4) piling the foundation structure: embedding the foundation structure into the improved foundation in the step (3) by a vibration equipment.

In the foundation treatment method for piling a foundation structure by penetrating a hardpan layer (DSM method) provided by the embodiment of the present application, disturbing a location where a steel plate cylinder or a similar foundation structure is to be piled by a mechanical device to penetrate a hardpan layer of a natural foundation, injecting clay slurry into the hole by a pumping device, fully mixing the clay slurry with the hardpan layer by a stirring device to break the original soil property of the hardpan layer and soften the hardpan layer, and the clay slurry is mixed with the original foundation soil to form a new mixed soil pile with uniform texture. The treated foundation has reduced bearing capacity during construction period and uniform texture. In the process of further piling the steel plate cylinder or similar foundation structure, since the original hardpan layer has been mixed with the clay slurry and water in pores of the soil has not been dissipated, the occlusion between soil particles is reduced, and the side friction resistance and tip resistance suffered by the foundation structure are reduced, and the driveability is increased. Meanwhile, due to the uniformity of the improved soil texture, the friction applied to the foundation structure by the soil body during the piling process is uniform, and the uneven force is reduced. After the piling is completed, the mixed soil pile is solidified due to water drainage, and the bearing capacity is gradually increased to meet the requirements for the bearing capacity during the use period.

As a preferred implementation, the mechanical device in the step (1) is one of a Cement Deep Mixing ship processor, a land drilling device and an excavating device.

As a preferred implementation, the disturbing in the step (1) is one of drilling, excavating and chiseling. It can be understood that the specific disturbing mode is related to the selected mechanical device. However, any disturbing mode can be adopted as long as the hardpan layer of the natural foundation can be penetrated by the mechanical device.

As a preferred implementation, the clay slurry in the step (2) is prepared from bentonite. The original soil property of the hardpan layer is broken by mixing the injected clay slurry with the hardpan layer of the natural foundation, so that a new mixed soil pile with uniform texture is formed.

Further, the clay slurry is prepared by mixing water and the bentonite, a mass ratio of water to the bentonite is equal to or greater than 0.7, and a specific gravity of the clay slurry is equal to or greater than 1.3. The clay slurry prepared under the abovementioned condition has good fluidity, and the property of the hardpan layer can be improved after mixing the clay slurry with the natural soil layer, so that the piling of the foundation structure can be facilitated.

Most preferably, the clay slurry is prepared by mixing water and the bentonite at a mass ratio of 1.15 and the specific gravity of the clay slurry is 1.48. The prepared clay slurry has good fluidity and can meet the requirements of slurry pumping on the ship, thus pipe blockage will not occur and the mixing effect with the natural layer will be good.

As a preferred implementation, a flow rate of the grouting in the step (2) is 250-450 L/min. The clay slurry is injected into the harden layer by the pumping device at the speed of 250-450 L/min and mixed with the harden layer, which can obviously soften the original harden foundation and facilitate the subsequent construction.

As a preferred implementation, the stirring device in the step (3) is a stirring wing at a lower end of the mechanical device in the step (1). In this embodiment, in order to save equipment investment, the stirring wing of the mechanical device itself is directly used for stirring, which makes the process more convenient.

As a preferred implementation, the foundation structure in the step (4) is one of a large-diameter steel plate cylinder, a steel plate cylinder, a combined steel plate cylinder and an arc structure of the large-diameter steel plate cylinder, the steel plate cylinder or the combined steel plate cylinder. The foundation structures listed in this embodiment are all commonly used components for construction projects at sea. However, it can be understood that the DSM method provided by the present application is not only applicable to the above components, but also applicable to components of other forms which need to be piled by penetrating harden layer.

As a preferred implementation, the specific operating steps of the steps (1), (2) and (3) comprises:

① selecting a construction ship, and mounting the mechanical device;

② determining a location where the hardpan layer is to be penetrated according to a designed piling location of the foundation structure, positioning the ship by a positioning apparatus such as GPS, an optical measurement instrument, a laser range finder and the like, and arranging the mechanical device in place;

③ checking operating state of a generator, ensuring that a water source of a water tank is sufficient, a fully-automated device works normally and a slurry pump is activated, determining a verticality of the mechanical device, checking instruments to ensure good operating state, and preparing for disturbance;

④ activating the generator, the fully-automated device runs normally, the mechanical device sinks rotationally and a cone tip at a lower end of the mechanical device enters water; controlling a sinking speed of the mechanical device to be 1.0 to 2.0 m/min until the cone tip reaches seabed;

⑤ the mechanical device continuously sinks rotationally, and controlling the sinking speed of the mechanical device to be 0.5 to 1.0 m/min during the cone tip descending from the seabed to a treatment top surface;

⑥ the mechanical device continuously sinks rotationally, controlling the sinking speed of the mechanical device to be 0.3 to 1.0 m/min during the cone tip descending from the treatment top surface to a treatment bottom surface; injecting the clay slurry through a slip pipe at a flow rate of 250-450 L/min, and adjusting the flow rate according to the sinking speed; rotating a stirring wing at the lower end of the mechanical device while sinking to mix soil body; in the grouting process, the flow rate of grouting is related to the soil strength of the natural foundation, a diameter of the stirring wing and a sinking speed of the stirring wing, those skilled in the art can empirically determine the optimum flow rate of grouting to ensure that the soil of unit length reaches a certain amount of grouting. For example, in case where the soil strength of the natural foundation is constant, the slower the sinking speed, the smaller the flow rate of grouting; conversely, the faster the sinking speed, the larger the flow rate of grouting. In case where the flow rate of grouting is constant, the higher the soil strength of the natural foundation, the slower the sinking speed is required.

⑦ the mechanical device stops sinking after the cone tip reaches the treatment bottom surface, the stirring wing at the lower end of the mechanical device continuously rotates to mix the soil body for 3 to 5 min so as to fully mix natural soil with the clay slurry;

⑧ activating a reverse switch, reversely rotating and lifting the stirring wing at the lower end of the mechanical device, and lifting the cone tip to the treatment top surface, and controlling a lifting speed to be 0.3 to 1.0 m/min;

⑨ repeating the steps ⑥ to ⑧ for 3 to 5 times to ensure that the clay slurry is fully mixed with the natural soil, so as to form the improved foundation; and ⑩ lifting the stirring wing at the lower end of the mechanical device from the treatment top surface to sea surface, controlling the lifting speed to be 0.3 to 1.0 m/min, and moving the mechanical device to a next location where the hardpan layer is to be penetrated.

In the above embodiment, the treatment top surface is a top surface of the harden layer below the seabed silt layer, and the treatment bottom surface is a bottom surface of the harden layer.

The present application will be further described below by embodiments.

Embodiment 1

A foundation treatment method for piling a foundation structure by penetrating a hardpan layer (DSM method) is provided, specifically comprising the following construction steps.

1. Site Investigation:

Site investigation is performed on a natural foundation where a steel plate cylinder or other foundation structure is to be piled, specifically comprising water depth measurement, exploration, soil survey and environmental survey.

① The water depth measurement is performed to obtain foundation elevations before and after construction, a construction ship is selected according to water depth environment.

② A construction range is explored by a diver, to determine whether there are barriers that hinder the construction.

③ A soil survey is performed in a construction region of deep mixed soil piles by drilling or in other ways, to determine difference in soil texture between different locations.

④ Considering locations of fisheries, farms, bathing beaches and factory water intakes, surveys of water quality, noise and vibration are performed to prevent loss of clay slurry material from adversely influencing ecological environment.

2. Preparation Before Piling:

In accordance with the result of the site investigation and depending upon predetermined location of the steel plate cylinder or other foundation structure to be piled, locations of deep mixed soil piles are determined; and, according to soil texture, a diameter of the steel plate cylinder and strike capability, a distance between the mixed soil piles is controlled to be 1 to 10 m and not less than 1 time of the pile diameter.

3. Specific Construction:

① A construction ship is selected, and a CDM ship processor is mounted.

② A location where the hardpan layer is to be penetrated is determined according to a designed piling location, the ship is positioned by GPS, an optical measurement instrument, a laser range finder and the like, and the CDM ship processor is arranged in place.

③ An operating state of a generator is checked, and a water source of a water tank is guaranteed to be sufficient, a fully-automated device works normally, a slurry pump is activated, a verticality of a drilling device is confirmed, instruments are checked to ensure good operating state, and it is ready for drilling.

④ The generator is activated, the fully-automated device runs normally, the CDM ship processor sinks rotationally, a cone tip of a stirring wing at a lower end of the CDM ship processor is allowed to enter water, and a sinking speed of the mechanical device is controlled to be 1.0 m/min until the cone tip reaches the seabed.

⑤ The CDM ship processor continuously sinks rotationally, and the sinking speed of the mechanical device is controlled to be 0.5 m/min during the cone tip descending from the seabed to a treatment top surface.

⑥ The CDM ship processor continuously sinks rotationally, and the speed of the mechanical device is controlled to be 0.3 m/min during the cone tip descending from the treatment top surface to a treatment bottom surface; clay slurry is injected through a slip pipe, and the stirring wing at the lower end is rotated while sinking to mix soil body. Wherein, a mass ratio of water to bentonite in the clay slurry is 1.15, and a specific gravity of the clay slurry is 1.48; a flow rate of grouting is 300 L/min.

⑦ The CDM ship processor stops sinking after the cone tip reaches the treatment bottom surface, and the stirring wing is continuously rotated to mix the soil body for 5 min so that natural soil is fully mixed with the clay slurry.

⑧ A reverse switch is activated, the stirring wing at the lower end of the CDM ship processor is rotated reversely to lift, and the cone tip is lifted to the treatment top surface. The lifting speed during this process is controlled to be 0.3 m/min.

⑨ The steps ⑥ to ⑧ are repeated for 3 to 5 times to ensure that the clay slurry is fully mixed with the natural soil, so as to form an improved foundation.

⑩ The stirring wing at the lower end of the CDM ship processor is lifted from the treatment top surface to the sea surface, the lifting speed is controlled to be 0.3 m/min, and the CDM ship processor is moved to a next location where the hardpan layer is to be penetrated.

4. The piling machine or the construction ship is moved to a next pile location, and the step 3 is repeated for piling of the deep mixed soil pile. After construction of the deep mixed soil pile, an original foundation surface will be bumped. The bumped portion can be removed according to engineering requirements, and a sand cushion having a certain thickness is paved to prepare for the piling of the steel plate cylinder.

5. The piling of the steel plate cylinder or the foundation structure is started. The steel plate cylinder is hoisted and moved to the predetermined piling location, the cylinder wall is arranged along a location of a connecting line of centers of the mixed soil piles, and a strike hammer is activated for piling.

Embodiment 2

A foundation treatment method for piling a foundation structure by penetrating a hardpan layer (DSM method) is provided, specifically comprising the following construction steps.

1. Site Investigation:

Site investigation is performed on a natural foundation where a steel plate cylinder or other foundation structure is to be piled, specifically comprising water depth measurement, exploration, soil survey and environmental survey.

① The water depth measurement is performed to obtain foundation elevations before and after construction, a construction ship is selected according to water depth environment.

② A construction range is explored by a diver, to determine whether there are barriers that hinder the construction.

③ A soil survey is performed in a construction region of deep mixed soil piles by drilling or in other ways, to determine difference in soil texture between different locations.

④ Considering locations of fisheries, farms, bathing beaches and factory water intakes, surveys of water quality, noise and vibration are performed to prevent loss of clay slurry material from adversely influencing ecological environment.

2. Preparation Before Piling:

In accordance with the result of the site investigation and depending upon predetermined location of the steel plate cylinder or other foundation structure to be piled, locations of deep mixed soil piles are determined; and, according to soil texture, a diameter of the steel plate cylinder and strike capability, a distance between the mixed soil piles is controlled to be 1 to 10 m and not less than 1 time of the pile diameter.

3. Specific Construction:

① A construction ship is selected, and a CDM ship processor is mounted.

② A location where the hardpan layer is to be penetrated is determined according to a designed piling location, the ship is positioned by GPS, an optical measurement instrument, a laser range finder and the like, and the CDM ship processor is arranged in place.

③ An operating state of a generator is checked, and a water source of a water tank is guaranteed to be sufficient, a fully-automated device works normally, a slurry pump is activated, a verticality of a drilling device is confirmed, instruments are checked to ensure good operating state, and it is ready for drilling.

④ The generator is activated, the fully-automated device runs normally, the CDM ship processor sinks rotationally, a cone tip of a stirring wing at a lower end of the CDM ship processor is allowed to enter water, and a sinking speed of the mechanical device is controlled to be 2.0 m/min until the cone tip reaches the seabed.

⑤ The CDM ship processor continuously sinks rotationally, and the sinking speed of the mechanical device is controlled to be 1.0 m/min during the cone tip descending from the seabed to a treatment top surface.

⑥ The CDM ship processor continuously sinks rotationally, and the speed of the mechanical device is controlled to be 1.0 m/min during the cone tip descending from the treatment top surface to a treatment bottom surface; clay slurry is injected through a slip pipe, and the stirring wing at the lower end is rotated while sinking to mix the soil body. Wherein, a mass ratio of water to bentonite in the clay slurry is 0.96, and a specific gravity of the clay slurry is 1.53; a flow rate of grouting is 400 L/min.

⑦ The CDM ship processor stops sinking after the cone tip reaches the treatment bottom surface, and the stirring wing is continuously rotated to mix the soil body for 3 min so that natural soil is fully mixed with the clay slurry.

⑧ A reverse switch is activated, the stirring wing at the lower end of the CDM ship processor is rotated reversely to lift, and the cone tip is lifted to the treatment top surface. The lifting speed during this process is controlled to be 1.0 m/min.

⑨ The steps ⑥ to ⑧ are repeated for 3 to 5 times to ensure that the clay slurry is fully mixed with the natural soil, so as to form an improved foundation.

⑩ The stirring wing at the lower end of the CDM ship processor is lifted from the treatment top surface to the sea surface, the lifting speed is controlled to be 1.0 m/min, and the CDM ship processor is moved to a next location where the hardpan layer is to be penetrated.

4. The piling machine or the construction ship is moved to a next pile location, and the step 3 is repeated for piling of the deep mixed soil pile. After construction of the deep mixed soil pile, an original foundation surface will be bumped. The bumped portion can be removed according to engineering requirements, and a sand cushion having a certain thickness is paved to prepare for the piling of the steel plate cylinder.

5. The piling of the steel plate cylinder or the foundation structure is started. The steel plate cylinder is hoisted and moved to the predetermined piling location, the cylinder wall is arranged along a location of a connecting line of centers of the mixed soil piles, and a strike hammer is activated for piling.

Embodiment 3

A foundation treatment method for piling a foundation structure by penetrating a hardpan layer (DSM method) is provided, specifically comprising the following construction steps.

1. Site Investigation:

Site investigation is performed on a natural foundation where a steel plate cylinder or other foundation structure is to be piled, specifically comprising water depth measurement, exploration, soil survey and environmental survey.

① The water depth measurement is performed to obtain foundation elevations before and after construction, a construction ship is selected according to water depth environment.

② A construction range is explored by a diver, to determine whether there are barriers that hinder the construction.

③ A soil survey is performed in a construction region of deep mixed soil piles by drilling or in other ways, to determine difference in soil texture between different locations.

④ Considering locations of fisheries, farms, bathing beaches and factory water intakes, surveys of water quality, noise and vibration are performed to prevent loss of clay slurry material from adversely influencing ecological environment.

2. Preparation Before Piling:

In accordance with the result of the site investigation and depending upon predetermined location of the steel plate cylinder or other foundation structure to be piled, locations of deep mixed soil piles are determined; and, according to soil texture, a diameter of the steel plate cylinder and strike capability, a distance between the mixed soil piles is controlled to be 1 to 10 m and not less than 1 time of the pile diameter. 3. Specific construction:

① A construction ship is selected, and a CDM ship processor is mounted.

② A location where the hardpan layer is to be penetrated is determined according to a designed piling location, the ship is positioned by GPS, an optical measurement instrument, a laser range finder and the like, and the CDM ship processor is arranged in place.

③ An operating state of a generator is checked, and a water source of a water tank is guaranteed to be sufficient, a fully-automated device works normally, a slurry pump is activated, a verticality of a drilling device is confirmed, instruments are checked to ensure good operating state, and it is ready for drilling.

④ The generator is activated, the fully-automated device runs normally, the CDM ship processor sinks rotationally, a cone tip of a stirring wing at a lower end of the CDM ship processor is allowed to enter water, and a sinking speed of the mechanical device is controlled to be 1.6 m/min until the cone tip reaches the seabed.

⑤ The CDM ship processor continuously sinks rotationally, and the sinking speed of the mechanical device is controlled to be 0.8 m/min during the cone tip descending from the seabed to a treatment top surface.

⑥ The CDM ship processor continuously sinks rotationally, and the speed of the mechanical device is controlled to be 0.6 m/min during the cone tip descending from the treatment top surface to a treatment bottom surface; clay slurry is injected through a slip pipe, and the stirring wing at the lower end is rotated while sinking to mix soil body. Wherein, a mass ratio of water to bentonite in the clay slurry is 1.1, and a specific gravity of the clay slurry is 1.50; a flow rate of grouting is 350 L/min.

⑦ The CDM ship processor stops sinking after the cone tip reaches the treatment bottom surface, and the stirring wing is continuously rotated to mix the soil body for 4 min so that natural soil is fully mixed with the clay slurry.

⑧ A reverse switch is activated, the stirring wing at the lower end of the CDM ship processor is rotated reversely to lift, and the cone tip is lifted to the treatment top surface. The lifting speed during this process is controlled to be 0.5 m/min.

⑨ The steps ⑥ to ⑧ are repeated for 3 to 5 times to ensure that the clay slurry is fully mixed with the natural soil, so as to form an improved foundation.

⑩ The stirring wing at the lower end of the CDM ship processor is lifted from the treatment top surface to the sea surface, the lifting speed is controlled to be 0.7 m/min, and the CDM ship processor is moved to a next location where the hardpan layer is to be penetrated.

4. The piling machine or the construction ship is moved to a next pile location, and the step 3 is repeated for piling of the deep mixed soil pile. After construction of the deep mixed soil pile, an original foundation surface will be bumped. The bumped portion can be removed according to engineering requirements, and a sand cushion having a certain thickness is paved to prepare for the piling of the steel plate cylinder.

5. The piling of the steel plate cylinder or the foundation structure is started. The steel plate cylinder is hoisted and moved to the predetermined piling location, the cylinder wall is arranged along a location of a connecting line of centers of the mixed soil piles, and a strike hammer is activated for piling.

In addition, control key points of the present application during the construction process are as follows:

① Arrangement locations of the mixed soil piles are determined according to a location of the cylinder wall of the steel plate cylinder.

② During preparation of the clay slurry, the clay slurry should be fully stirred and should not have large clay blocks, and should be checked and tested by a special person.

③ Before the clay slurry is pumped, a slurry delivery pipe and the slip pipe are cleaned with clean water to prevent from blockage. If the blockage occurs, stop pumping the clay slurry and washing with clean water.

④ A deviation of the verticality of the deep mixed soil pile is not greater than 1%, and a deviation of a plane location of the pile is not greater than 10 cm.

The steel plate cylinders piled by the DSM method of embodiments 1-3 can smoothly penetrate the natural harden layer, and a construction precision is high, a plane deviation is less than or equal to 350 mm, a verticality is less than or equal to 1%, and a lock plane deviation is less than or equal to 2°, which can meet the construction requirements of the steel plate cylinders.

Although the present application has been exemplarily described above, it is obvious that the specific implementations of the present application are not limited by the above modes. Various improvements made by using the method concepts and technical solutions of the present application or direct application thereof in other occasions shall fall into the protection scope of the present application.

What is claimed is:

1. A foundation treatment method for piling a foundation structure by penetrating a hardpan layer, comprising the following operating steps:

step (1) disturbing: disturbing, by a mechanical device, a location where the foundation structure is to be piled, so that the mechanical device penetrates the hardpan layer of a natural foundation;

step (2) grouting: injecting clay slurry into the location disturbed in the step (1) by a pumping device;

step (3) mixing: mixing the clay slurry in the step (2) with the hardpan layer of the natural foundation by a stirring device to form an improved foundation; and step (4) piling the foundation structure: embedding the foundation structure into the improved foundation in the step (3) by a vibration equipment;

wherein the clay slurry is prepared from bentonite by mixing water and the bentonite, a mass ratio of water to the bentonite is equal to or greater than 0.7, and a specific gravity of the clay slurry is equal to or greater than 1.3.

2. The foundation treatment method according to claim 1, wherein the mechanical device in the step (1) is one of a cement deep mixing ship processor, a land drilling device and an excavating device.

3. The foundation treatment method according to claim 1, wherein the disturbing in the step (1) is one of drilling, excavating and chiseling.

4. The foundation treatment method according to claim 3, wherein a flow rate of the grouting in the step (2) is 250-450 L/min.

5. The foundation treatment method according to claim 4, wherein the stirring device in the step (3) is a stirring wing at a lower end of the mechanical device in the step (1).

6. The foundation treatment method according to claim 5, wherein the foundation structure in the step (4) is one of a large-diameter steel plate cylinder, a steel plate cylinder, a combined steel plate cylinder and an arc structure of the large-diameter steel plate cylinder, the steel plate cylinder or the combined steel plate cylinder.

7. The foundation treatment method according to claim 1, wherein the clay slurry is prepared by mixing water and the bentonite at a mass ratio of 1.15 and the specific gravity of the clay slurry is 1.48.

8. The foundation treatment method according to claim 7, wherein a flow rate of the grouting in the step (2) is 250-450 L/min.

9. The foundation treatment method according to claim 8, wherein the stirring device in the step (3) is a stirring wing at a lower end of the mechanical device in the step (1).

10. The foundation treatment method according to claim 9, wherein the foundation structure in the step (4) is one of a large-diameter steel plate cylinder, a steel plate cylinder, a combined steel plate cylinder and an arc structure of the large-diameter steel plate cylinder, the steel plate cylinder or the combined steel plate cylinder.

11. The foundation treatment method according to claim 1, wherein a flow rate of the grouting in the step (2) is 250-450 L/min.

12. The foundation treatment method according to claim 1, wherein the stirring device in the step (3) is a stirring wing at a lower end of the mechanical device in the step (1).

13. The foundation treatment method according to claim 1, wherein the foundation structure in the step (4) is one of a large-diameter steel plate cylinder, a steel plate cylinder, a combined steel plate cylinder and an arc structure of the large-diameter steel plate cylinder, the steel plate cylinder or the combined steel plate cylinder.

14. The foundation treatment method according to claim 1, wherein the specific operating steps of the steps (1), (2) and (3) comprise:

step 1: selecting a construction ship, and mounting the mechanical device;

step 2: determining a location where the hardpan layer is to be penetrated according to a designed piling location of the foundation structure, positioning the ship by a positioning apparatus, and arranging the mechanical device in place;

step 3: checking operating state of a generator, ensuring that a water source of a water tank is sufficient, a fully-automated device works normally and a slurry pump is activated, determining a verticality of the mechanical device, checking instruments to ensure good operating state, and preparing for disturbance;

step 4: activating the generator, the fully-automated device runs normally, the mechanical device sinks rotationally and a cone tip at a lower end of the mechanical device enters water; controlling a sinking speed of the mechanical device to be 1.0 to 2.0 m/min until the cone tip reaches seabed;

step 5: the mechanical device continuously sinks rotationally, and controlling the sinking speed of the mechanical device to be 0.5 to 1.0 m/min during the cone tip descending from the seabed to a treatment top surface;

step 6: the mechanical device continuously sinks rotationally, controlling the sinking speed of the mechanical device to be 0.3 to 1.0 m/min during the cone tip descending from the treatment top surface to a treatment bottom surface; injecting the clay slurry through a slip pipe at a flow rate of 250-450 L/min, and rotating a stirring wing at the lower end of the mechanical device while sinking to mix soil body;

step 7: the mechanical device stops sinking after the cone tip reaches the treatment bottom surface, the stirring wing at the lower end of the mechanical device continuously rotates to mix the soil body for 3 to 5 min so as to fully mix natural soil with the clay slurry;

step 8: activating a reverse switch, reversely rotating and lifting the stirring wing at the lower end of the mechanical device, and lifting the cone tip to the treatment top surface, and controlling a lifting speed to be 0.3 to 1.0 m/min;

step 9: repeating the steps 6 to 8 for 3 to 5 times to ensure that the clay slurry is fully mixed with the natural soil, so as to form the improved foundation; and step 10: lifting the stirring wing at the lower end of the mechanical device from the treatment top surface to sea surface, controlling the lifting speed to be 0.3 to 1.0 m/min, and moving the mechanical device to a next location where the hardpan layer is to be penetrated.

15. A foundation treatment method for piling a foundation structure by penetrating a hardpan layer, comprising the following operating steps:

step (1) disturbing: disturbing, by a mechanical device, a location where the foundation structure is to be piled, so that the mechanical device penetrates the hardpan layer of a natural foundation;

step (2) grouting: injecting clay slurry into the location disturbed in the step (1) by a pumping device;

step (3) mixing: mixing the clay slurry in the step (2) with the hardpan layer of the natural foundation by a stirring device to form an improved foundation; and step (4) piling the foundation structure: embedding the foundation structure into the improved foundation in the step (3) by a vibration equipment;

wherein the specific operating steps of the steps (1), (2) and (3) comprise:

step 1: selecting a construction ship, and mounting the mechanical device;

step 2: determining a location where the hardpan layer is to be penetrated according to a designed piling location of the foundation structure, positioning the ship by a positioning apparatus, and arranging the mechanical device in place;

step 3: checking operating state of a generator, ensuring that a water source of a water tank is sufficient, a fully-automated device works normally and a slurry pump is activated, determining a verticality of the mechanical device, checking instruments to ensure good operating state, and preparing for disturbance;

step 4: activating the generator, the fully-automated device runs normally, the mechanical device sinks rotationally and a cone tip at a lower end of the mechanical device enters water; controlling a sinking speed of the mechanical device to be 1.0 to 2.0 m/min until the cone tip reaches seabed;

step 5: the mechanical device continuously sinks rotationally, and controlling the sinking speed of the mechanical device to be 0.5 to 1.0 m/min during the cone tip descending from the seabed to a treatment top surface;

step 6: the mechanical device continuously sinks rotationally, controlling the sinking speed of the mechanical device to be 0.3 to 1.0 m/min during the cone tip descending from the treatment top surface to a treatment bottom surface; injecting the clay slurry through a slip pipe at a flow rate of 250-450 L/min, and rotating a stirring wing at the lower end of the mechanical device while sinking to mix soil body;

step 7: the mechanical device stops sinking after the cone tip reaches the treatment bottom surface, the stirring wing at the lower end of the mechanical device continuously rotates to mix the soil body for 3 to 5 min so as to fully mix natural soil with the clay slurry;

step 8: activating a reverse switch, reversely rotating and lifting the stirring wing at the lower end of the mechanical device, and lifting the cone tip to the treatment top surface, and controlling a lifting speed to be 0.3 to 1.0 m/min;

step 9: repeating the steps 6 to 8 for 3 to 5 times to ensure that the clay slurry is fully mixed with the natural soil, so as to form the improved foundation; and step 10: lifting the stirring wing at the lower end of the mechanical device from the treatment top surface to sea surface, controlling the lifting speed to be 0.3 to 1.0 m/min, and moving the mechanical device to a next location where the hardpan layer is to be penetrated.

16. The foundation treatment method according to claim 15, wherein a flow rate of the grouting in the step (2) is 250-450 L/min.

17. The foundation treatment method according to claim 16, wherein the stirring device in the step (3) is a stirring wing at a lower end of the mechanical device in the step (1).

18. The foundation treatment method according to claim 17, wherein the foundation structure in the step (4) is one of a large-diameter steel plate cylinder, a steel plate cylinder, a combined steel plate cylinder and an arc structure of the large-diameter steel plate cylinder, the steel plate cylinder or the combined steel plate cylinder.

* * * * *